US007632467B1

(12) United States Patent
Mason

(10) Patent No.: US 7,632,467 B1
(45) Date of Patent: Dec. 15, 2009

(54) APPARATUS FOR AUTOMATED STORAGE AND RETRIEVAL OF MINIATURE SHELF KEEPING UNITS

(75) Inventor: Thomas K. Mason, Whitehall, MD (US)

(73) Assignee: Kardex Engineering, Inc., Paoli, PA (US)

( * ) Notice: Subject to any disclaimer, the term of this patent is extended or adjusted under 35 U.S.C. 154(b) by 195 days.

(21) Appl. No.: 10/319,159

(22) Filed: Dec. 13, 2002

Related U.S. Application Data

(60) Provisional application No. 60/340,284, filed on Dec. 13, 2001.

(51) Int. Cl.
*B01L 9/06* (2006.01)
*B01L 3/14* (2006.01)

(52) U.S. Cl. ..... 422/102; 422/99; 422/104; 422/63

(58) Field of Classification Search ..... 422/102, 422/58, 104, 65, 63, 99; 99/583; 206/557; 211/85.13, 126.1; 494/20; 446/118
See application file for complete search history.

(56) References Cited

U.S. PATENT DOCUMENTS 3,701,434 A * 10/1972 Moore ..... 210/477
4,004,837 A * 1/1977 Main ..... 301/37.42
4,052,161 A * 10/1977 Atwood et al. ..... 436/34
4,154,795 A * 5/1979 Thorne ..... 422/99
4,211,338 A * 7/1980 Bublitz ..... 220/359.4
4,968,625 A * 11/1990 Smith et al. ..... 435/305.3
5,084,246 A * 1/1992 Lyman et al. ..... 422/101
5,494,830 A * 2/1996 Hubscher ..... 436/518
5,525,304 A * 6/1996 Matsson et al. ..... 422/104
6,159,368 A * 12/2000 Moring et al. ..... 210/321.75
2002/0083686 A1* 7/2002 Audino et al. ..... 53/478
2003/0021727 A1* 1/2003 Weyker et al. ..... 422/58
2005/0052646 A1* 3/2005 Wohlstadter et al. ..... 356/311

* cited by examiner

*Primary Examiner*—Jill Warden
*Assistant Examiner*—Paul S Hyun
(74) *Attorney, Agent, or Firm*—Eugene E. Renz, Jr., PC

(57) ABSTRACT

An automated pharmaceutical or biotech compound testing system uses a very small molded plastic shelf keeping unit or test tube known as a "minitube". The minitubes are stored in trays in a standing refrigeration unit and are retrieved by a machine or robot having a die cutting tubular end effector adapted to selectively cut away and remove a minitube from an integrally molded matrix containing hundreds of minitubes (e.g., 384). Upon cutting a selected minitube away from the matrix, the end effector is pushed down over the selected minitube, thus forcing the minitube into the cylindrical interior lumen of the end effector, where it is retained by friction fit until such time as the minitube is to be releaseably locked into a plastic receiving tray. Minitubes are stored in the plastic tray which is adapted to receive and releaseably hold or lock the tubes in place.

3 Claims, 15 Drawing Sheets

APPARATUS FOR AUTOMATED STORAGE AND RETRIEVAL OF MINIATURE SHELF KEEPING UNITS

PRIOR APPLICATION INFORMATION

This application claims benefit from co-pending and commonly owned provisional patent application No. 60/340,284, which was filed Dec. 13, 2001, the entire disclosure of which is incorporated herein by reference.

BACKGROUND OF THE INVENTION

1. Field of the Invention

The present invention relates to automated chemical, pharmaceutical or biotech compound testing systems using miniature shelf keeping units or test tubes. The shelf keeping units or test tubes are preferably stored in a standing refrigeration unit and are retrieved by a robot.

2. Discussion of the Prior Art

In prior art systems, shelf keeping unit parts are separately molded to provide, for example, an array of 384 miniature shelf keeping units or test tubes; the tubes are inserted in a matrix of 384 square sockets, thus requiring a very costly assembly.

Industry standards promulgated (in draft form) by the Society for Biomolecular Screening ("SBS") specify standard dimensions and characteristics for microtiter plates (or microplates). The SBS homepage is attached hereto as appendix A; the SBS Microplate Standards Development Committee web page printout is attached hereto as appendix B. The SBS Microplate Standards Development Committee draft standard SBS-1 (Footprint Dimensions) is attached hereto as appendix C, and the SBS Microplate Standards Development Committee draft standard SBS-4 (Well Positions) is attached hereto as appendix D. Taken together, these serve to enable a person of ordinary skill in the art to understand the specifications of the prior art shelf keeping units.

In use, a robotic retrieval system responds to requests wherein individual tubes are taken from a plate and moved in a process called reformatting; the tubes are moved to another plate, e.g., having a different makeup of compound. In executing a reformatting request for a random assortment of tubes in many plates throughout the system, one tube can be taken from each plate and put it in another set-up of plates, ordering the tubes in accordance with the request.

The shelf keeping units or tubes are accessed by pipettes having tips dimensioned to fit into the tubes, for withdrawing fluid from the tubes or dispensing fluid into the tubes. Scientific Equipment vendors such as Globe Scientific, Inc. or CCS Packard supply pipette tips adapted for use with robotic or automated laboratory equipment. An excerpt of the "online catalog" taken from the Globe Scientific, Inc. web site describes tips designed to fit pipettors used in automated testing and is attached hereto as appendix E. Additionally, an excerpt of the "Chemicals and Supplies" information taken from the CCS Packard web site describes "Robotic Certified" pipette tips designed for use with 96 or 384 channel pipettors used in automated testing and is attached hereto as appendix F. Taken together, these serve to enable a person of ordinary skill in the art to understand the characteristics of pipettes used in conjunction with industry standard shelf keeping units.

The shelf keeping units or tubes of the prior art must be sealed for storage and automated handling and reliably sealing each shelf keeping unit is expensive and difficult, since each shelf keeping unit is small.

There is a need, therefore, for an economical and effective automated pharmaceutical or biotech compound testing system using a very small shelf keeping unit.

OBJECTS AND SUMMARY OF THE INVENTION

Accordingly, it is a primary object of the present invention to overcome the above mentioned difficulties by providing an economical and effective automated pharmaceutical or biotech compound testing system using a very small minitube shelf keeping unit.

In accordance with the present invention, an automated pharmaceutical or biotech compound testing system uses a very small molded plastic shelf keeping unit or test tube known as a "minitube". The minitubes are stored in trays in a standing refrigeration unit and are retrieved by a machine or robot having a die cutting tubular end effector adapted to selectively cut away and remove a minitube from an integrally molded matrix containing hundreds of minitubes (e.g., 384); the matrix is called a minitube well plate. Upon cutting a selected minitube away from the matrix, the end effector is pushed down over the selected minitube, thus forcing the minitube into the cylindrical interior lumen of the end effector, where it is retained by friction fit until such time as the minitube is to be releaseably locked into a plastic receiving tray.

Minitubes are stored in the plastic tray which is adapted to receive and releaseably hold or lock the tubes in place. The minitubes themselves are molded plastic tubes having distally projecting spaced apart "rabbit ear" detent lock members which are biased outwardly. The plastic receiving tray has apertures sized to receive the minitubes and each aperture of the tray is terminated at bottom in a hole defined within chamfered shoulders adapted to slidably engage and exert transverse force against the minitube rabbit ears. The two rabbit ears and the hole together comprise a detent lock system, the minitube rabbit ears releaseably engage the shoulder surfaces on the bottom of the hole in each aperture of the tray. The robot end effector can withdraw and replace the tubes as needed to perform automated testing.

The minitube receiving tray or plate includes spaces aligned in twenty four columns and rows A through P. That number of minitubes was selected for storage because the standard three hundred and eighty four element well plate from the Society for Biomolecular Screening (SBS) provides exterior dimensions (e.g., as cited above and described in the attached appendices). Conformance with the SBS standard was an important goal of developing the method and apparatus of present invention.

The problem presented was to mold the entire 384 well cassette (also referred to as the minitube well plate or matrix) as one unit, in a functional unit that doesn't need any further assembly. The minitube well plate just one piece, once out of the mold, already in a shape compatible with the format called the SBS Plate or the 384 well plate, so it's ready to use as-is, coming out of the mold.

In use, the individual minitubes are periodically taken out and "reformatted" into another plate, e.g., having a different makeup of compound in the minitubes. A receiving tray may include, for example a random assortment in the 384 well plates throughout the system and a user may need to pick one out of each of these plates and put it in another entire set-up of plates, ordering them for the request. In response to the request, the minitubes are punched out of a minitube well plate with the die end effector and placed in a receiving plate in such a way that the minitube can be used in the laboratory.

The minitube cannot be laid loosely in the plate aperture, instead, each minitube has to be pressed in and releaseably locked in or retained such that it won't come back out until selectively removed using the robot end effector.

The molded matrix structure including the minitubes molded integrally with the holder is referred to as the minitube well plate. The volume of each minitube is about sixty microlitres, and the exterior dimensions of each minitube are optimized to conform to the SBS spacing standard for dimensions a 384 tube well plate. The minitube design provides the largest volume that's functional in that format and size. Within the SBS standard format, the tube structure provides maximum usable volume. Each minitube has a rounded or pointed bottom, so that the pipette can reach close to the bottom, and get almost all of the material out. There are a large number of standard pipettes that are available. A cross-section of pipettes was studied to ensure they could fit down to the bottom easily without hitting the side. Well known pipette companies include Tecan, Becton-Dickenson, and Perkin Elmer.

Returning to the minitube well plate, the top surface is substantially planar and all of the minitubes are arranged in an evenly spaced pattern in a two dimensional array, in substantial conformance with the above cited SBS "well positions" draft standard, SBS-4. The minitube well plate shares of the present invention certain characteristics with standard (sBS-4) plate, but differs in the minitube configuration as seen from the bottom and in that the minitubes are integrally molded into the plate structure.

The top of the minitube well plate is planar upper surface which permits an operation covering all of the minitubes at once. On that planar top surface, and around each circular hole defining the minitube openings, where the minitube is molded in, there is a small annular ridge around each hole—one can feel the ridge with a fingernail. The annular ridge is raised and is used for heat sealing; a foil sheet with a polymer back is used to seal all the minitubes at once. The polymer layer melts to the polymer on the minitube well plate ridge, this independently sealing each tube at the annular ridge. The first point of contact is that little ridge around each well or minitube interior whereby each tube is completely sealed. Each minitube remains sealed after it's been cut and released by the die cutter and holder.

The preferred "membrane material" for affixing that sealing cover is a commercially available aluminum foil having a polymer coating on the back. The polymer coating may be polypropylene or polyethylene.

When attaching the foil to the minitube well plate, even heat and pressure is applied over the entire top surface using a pair of platens. A smooth top platen on the top surface and a platen underneath having holes cut out for each of the (e.g., 384) tubes so that the actual point of contact of the bottom platen is right at the top of the minitube well plate inner wall. Thus, when closed in the heat sealing operation, the two platens are essentially about a sixteenth of an inch apart, a span corresponding to the thickness of the minitube well plate top wall segment. During sealing, the bottom platen comes into intimate contact with the underside of the minitube well plate, and so acts essentially like a female mold, adapted to receive it the underside of the minitube well plate completely, whereas the top platen is just a flat rectangular piece that is slightly larger in area than the minitube well plate planar top surface.

During the heat sealing process, the minitube well plates are supported at the very bottom of the plate while the platen on top pushes down, so a very uniform pressure is applied, thereby achieving, among other things, enhanced reliability in the sealing of individual tubes.

Returning to the annular sealing ridge, the ridge is substantially triangular in cross section. This ridge shape is suitable for ultrasonic sealing as well as heat sealing and there's a pretty wide and forgiving range of ridge shape to present on a high spot to take the pressure first and achieve that melt. The melt must bond the sealing membrane completely around the circumference of the minitube and it is important that the bond that is created not be undone when the die cutter reaches in and cuts the minitube out of the well plate.

The die cutter shape or dimensions are dictated in part by that goal. Particularly, the die cutter has an angled edge, e.g., 20 degrees to the inside, whereby a knife-like beveled edge is presented. That beveled edge is very sharp, from a design tradeoff perspective, the balance is between having a shallower angle (rendering cleaner cut) or a larger angle (rendering longer wear, for longevity). At present, the priority is functionally making clean cuts, so the individual minitube seals are reliably left intact after the cutting step has taken place. A sharp cutting edge also helps maintain the flatness of that planar surface, over the whole plate, during the removal of all the tubes. The removal process is usually random in that tubes are removed at one point and then another and another. The typical completely random request process for the chemicals in these tubes might have three or four tubes remaining right in the middle after everything else is punched out around them, and a relatively flat well-oriented web must be maintained to hold those tubes. Another advantage of a very sharp cutting beveled edge is that, in use, the minitube well plate remains substantially planar as the tubes are cut out.

The minitube itself is tapered from top to bottom, having a gently decreasing diameter from top to bottom and being circular in cross-section. The die cutter has an interior defining a straight cylinder. The cutting edge is on the outside of the cylinder, and the outside is tapered for strength. The die cutter body also has a taper at the top that creates the beveled knife edge. There is a dual taper there; a two degree taper mirroring the minitube sidewall, so the adjacent minitubes allow for a two degree outward taper on the die. The minitube uses every bit of material that will fit within the clearances defined by adjacent placements of the die cutter. The die cutter taper gives enhanced tool strength and the tapered area around each minitube allows for that clearance and allows the die cutter to have that taper outward.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF THE PREFERRED EMBODIMENT

Figure 1A:
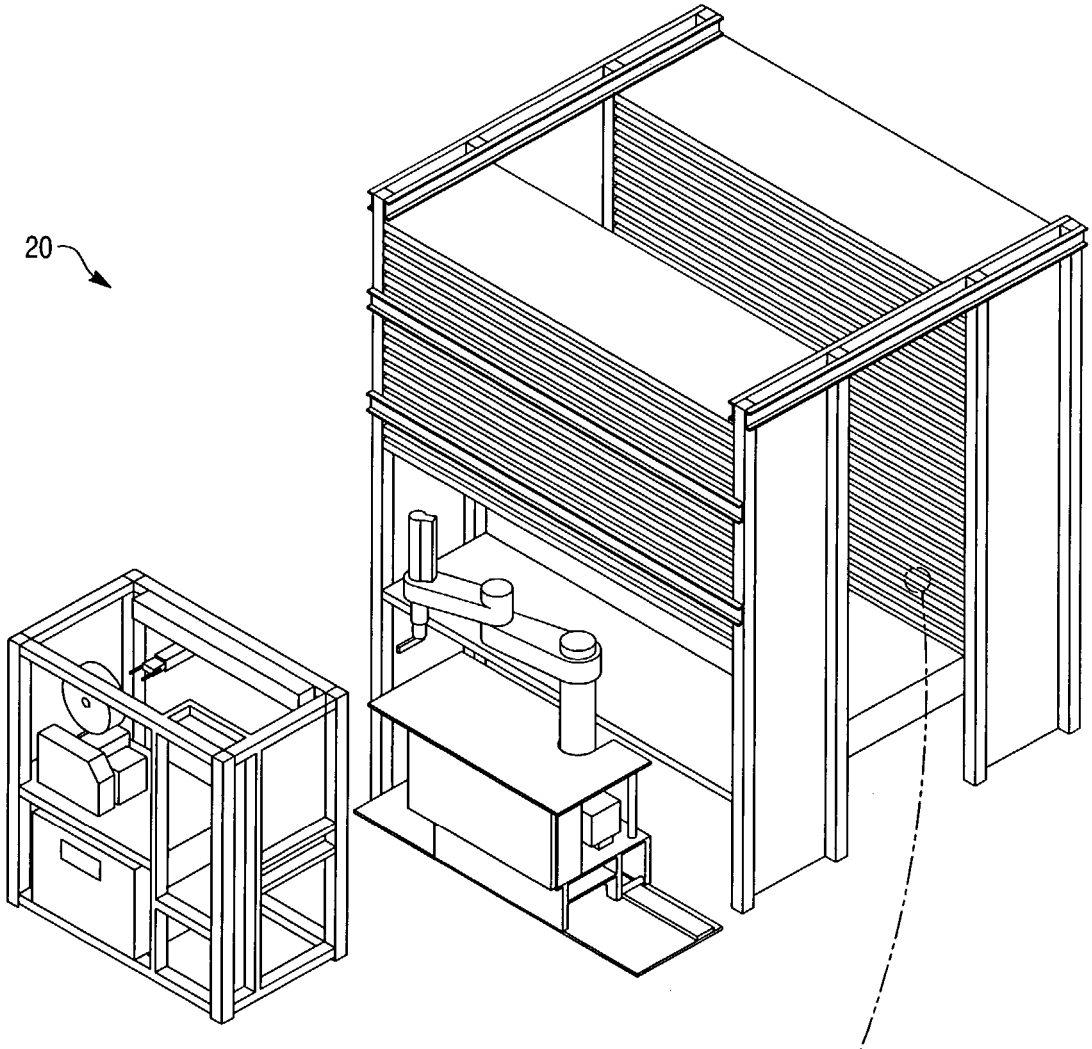
FIG. 1A is a perspective view of the entire automated retrieval system, in accordance with the present invention.
Figure 1B:
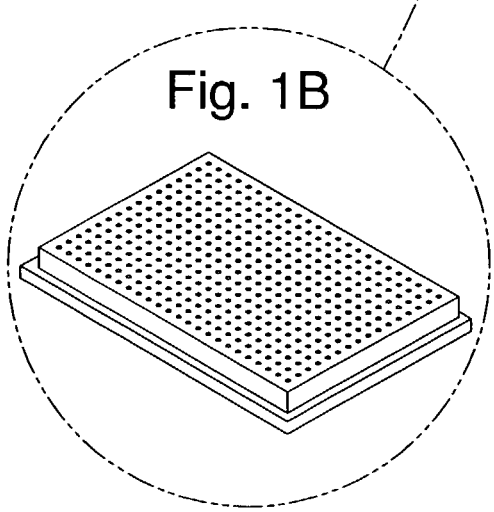
FIG. 1B is an enlarged, perspective view of a minitube well plate used in the automated retrieval system, in accordance with the present invention.
Figure 2:
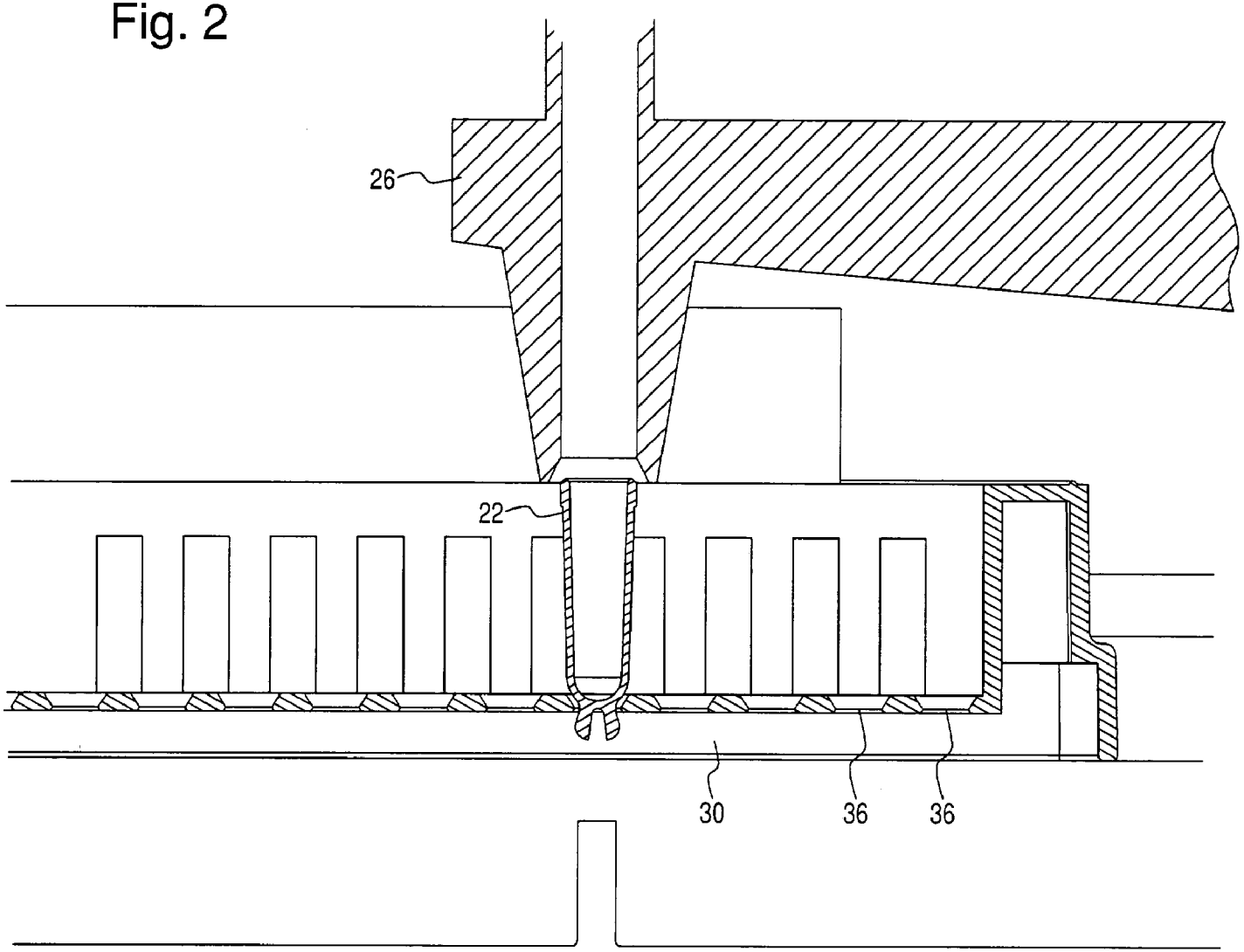
FIG. 2 is a cross sectional view of the robot end effector and receiving plate, with a locked-in minitube, in accordance with the present invention.
Figure 3:
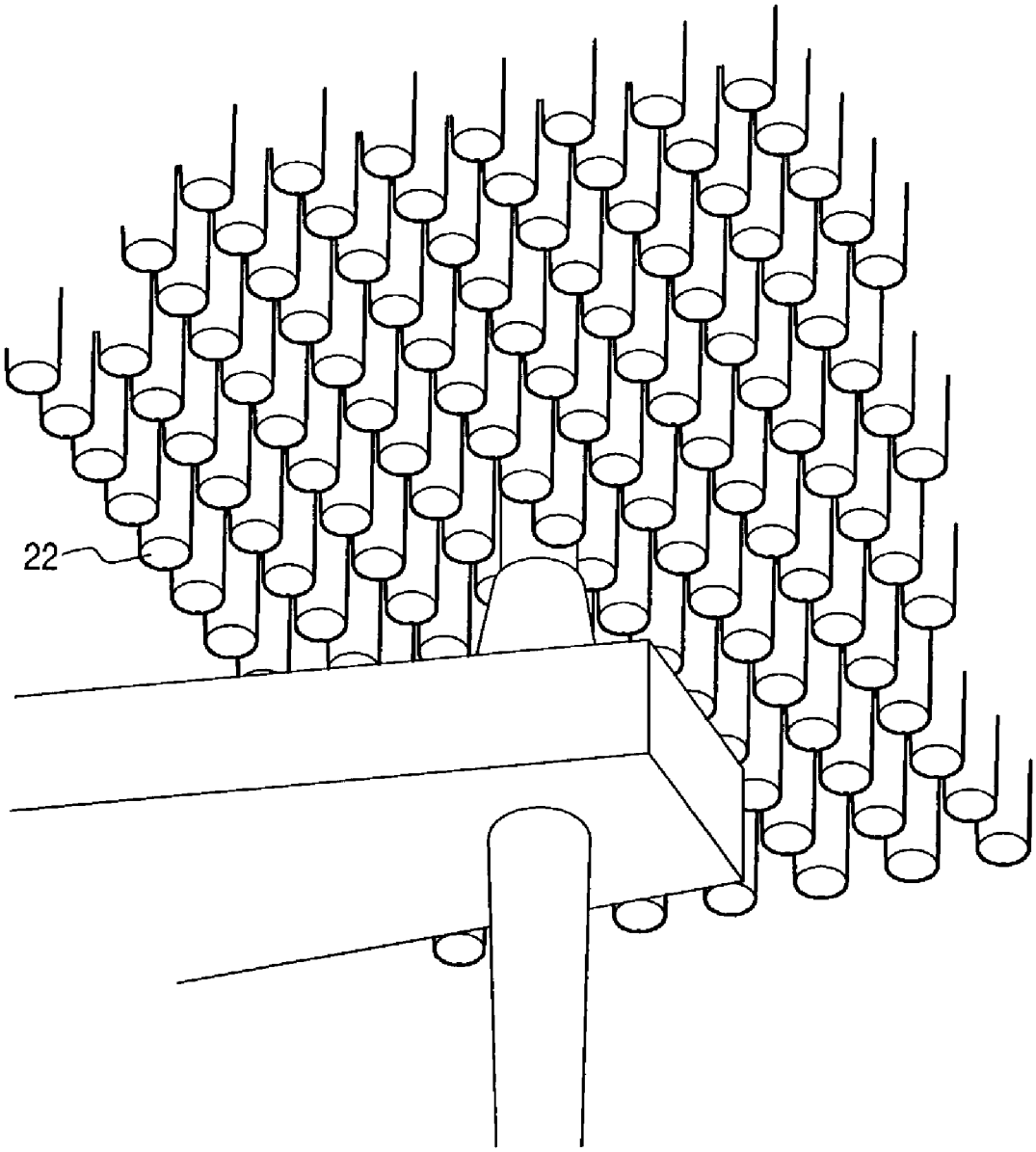
FIG. 3 is a perspective view of the minitube well plate or matrix and the die cutter end effector, in accordance with the present invention.
Figure 4:
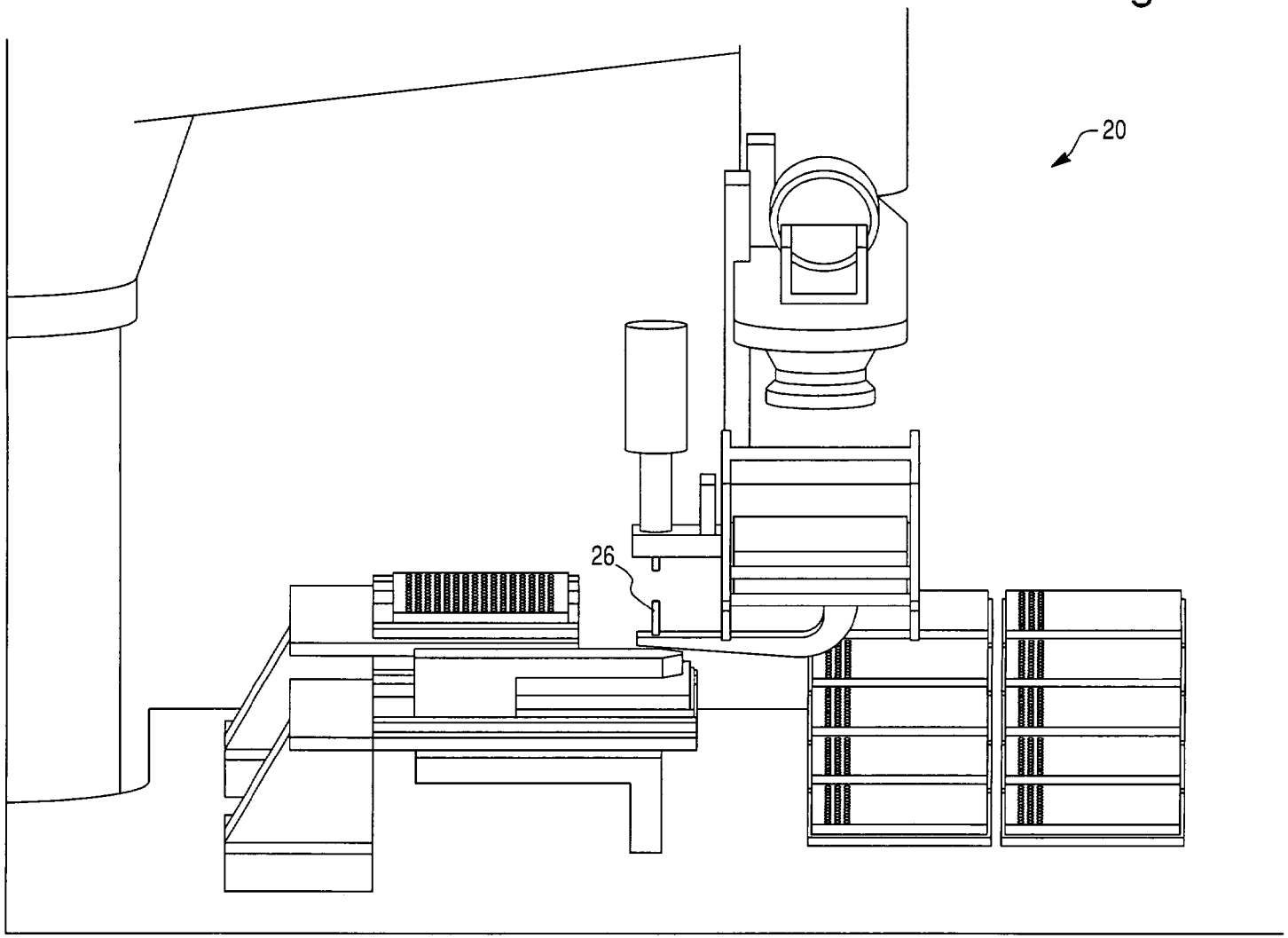
FIG. 4 is a front view, in elevation, of the minitube automated retrieval robot system, in accordance with the present invention.
Figure 5:
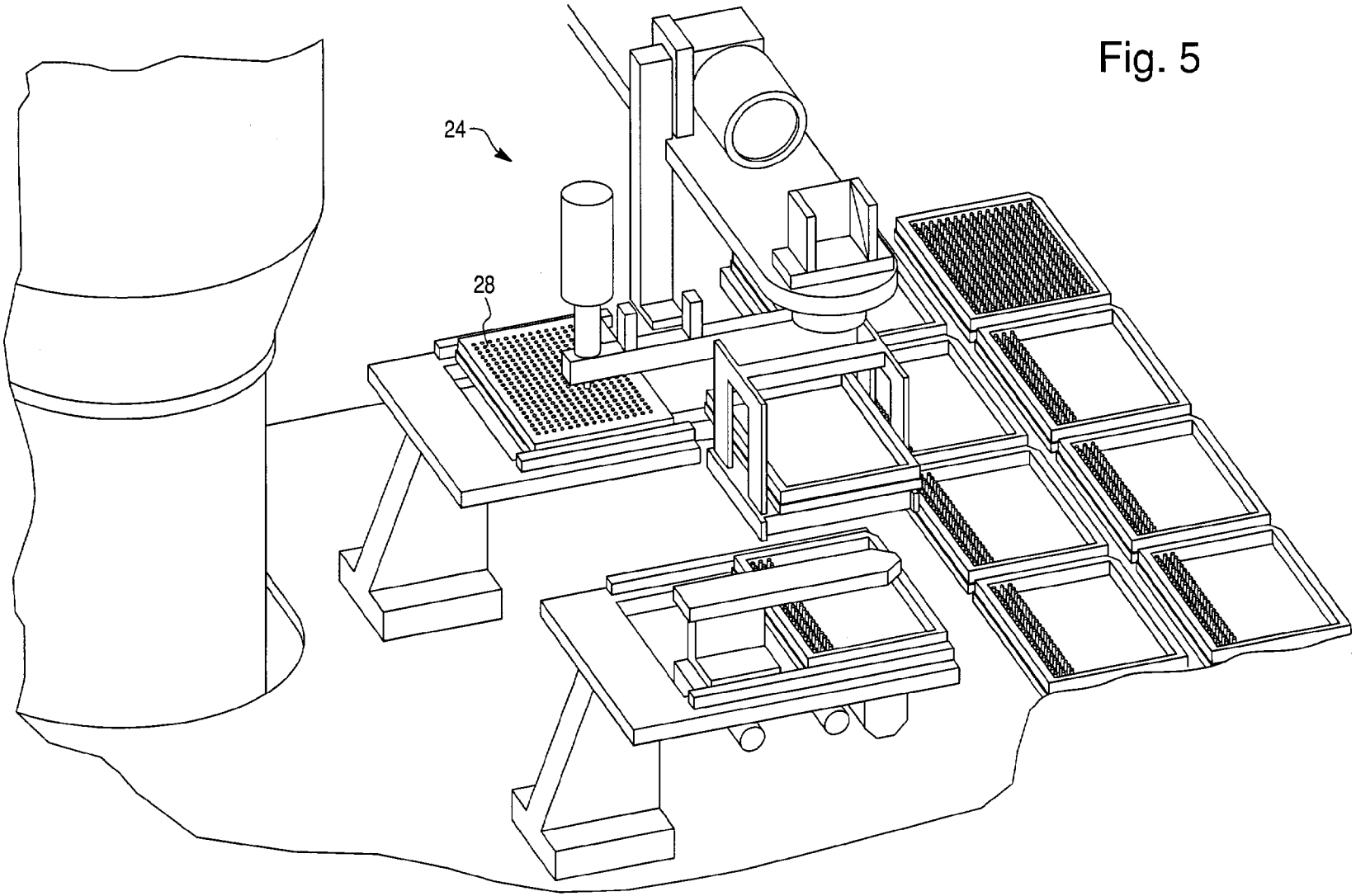
FIG. 5 is a perspective view of the minitube automated retrieval robot system, in accordance with the present invention.
Figure 6:
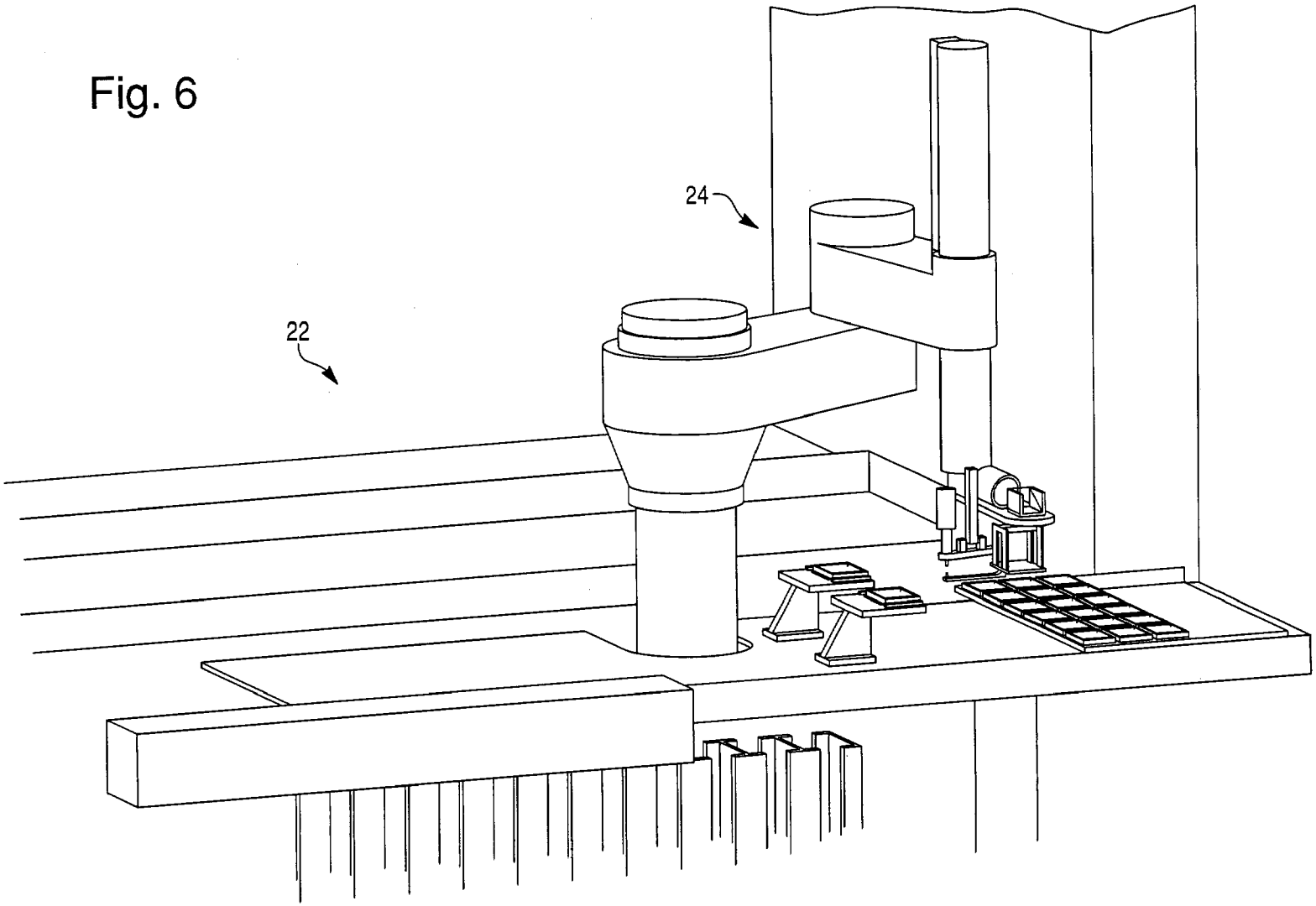
FIG. 6 is a perspective view of the minitube automated retrieval robot system, in accordance with the present invention.
Figure 9:
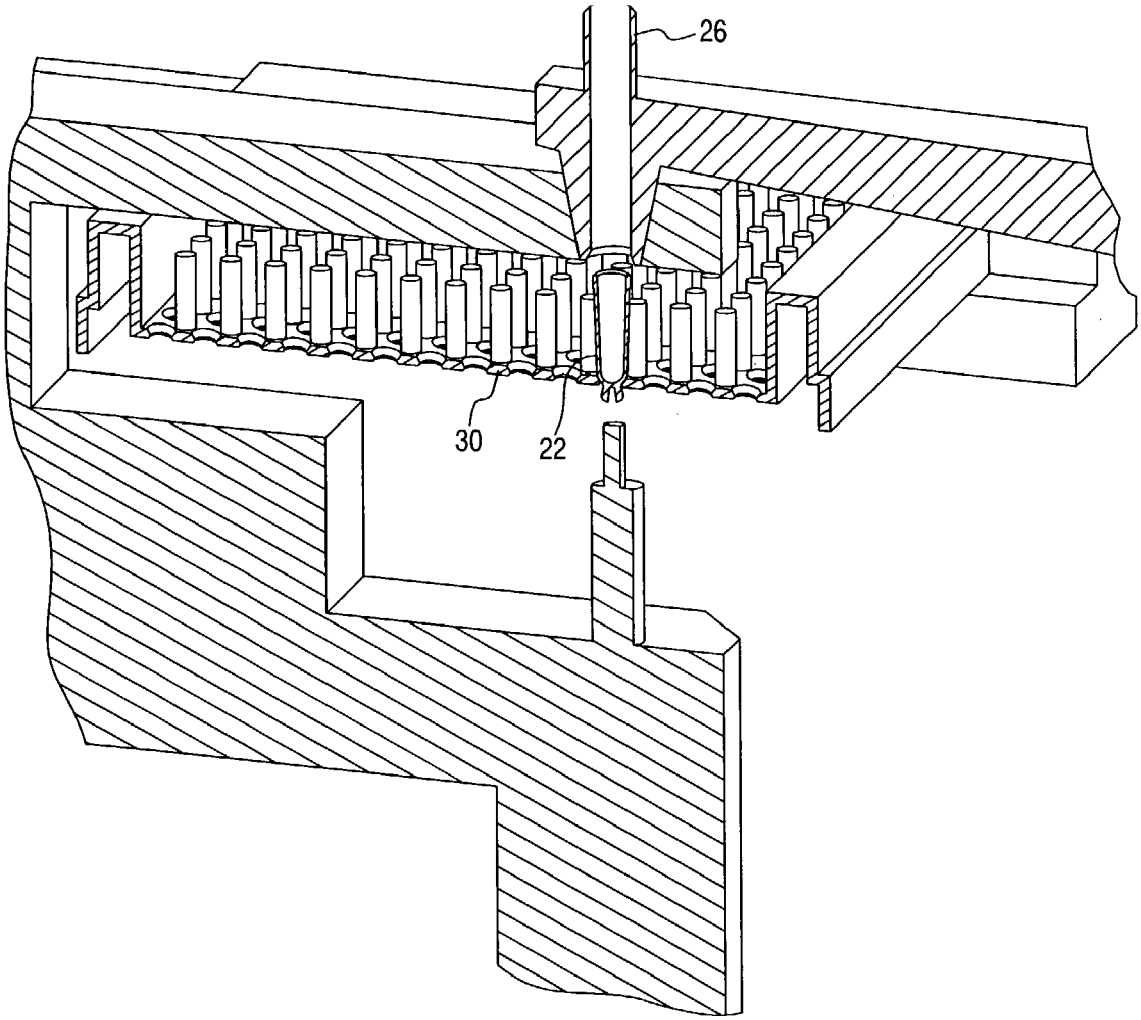
FIG. 9 is a cross sectional perspective view of the robot end effector, minitube and receiving plate, in accordance with the present invention.
Figure 10:
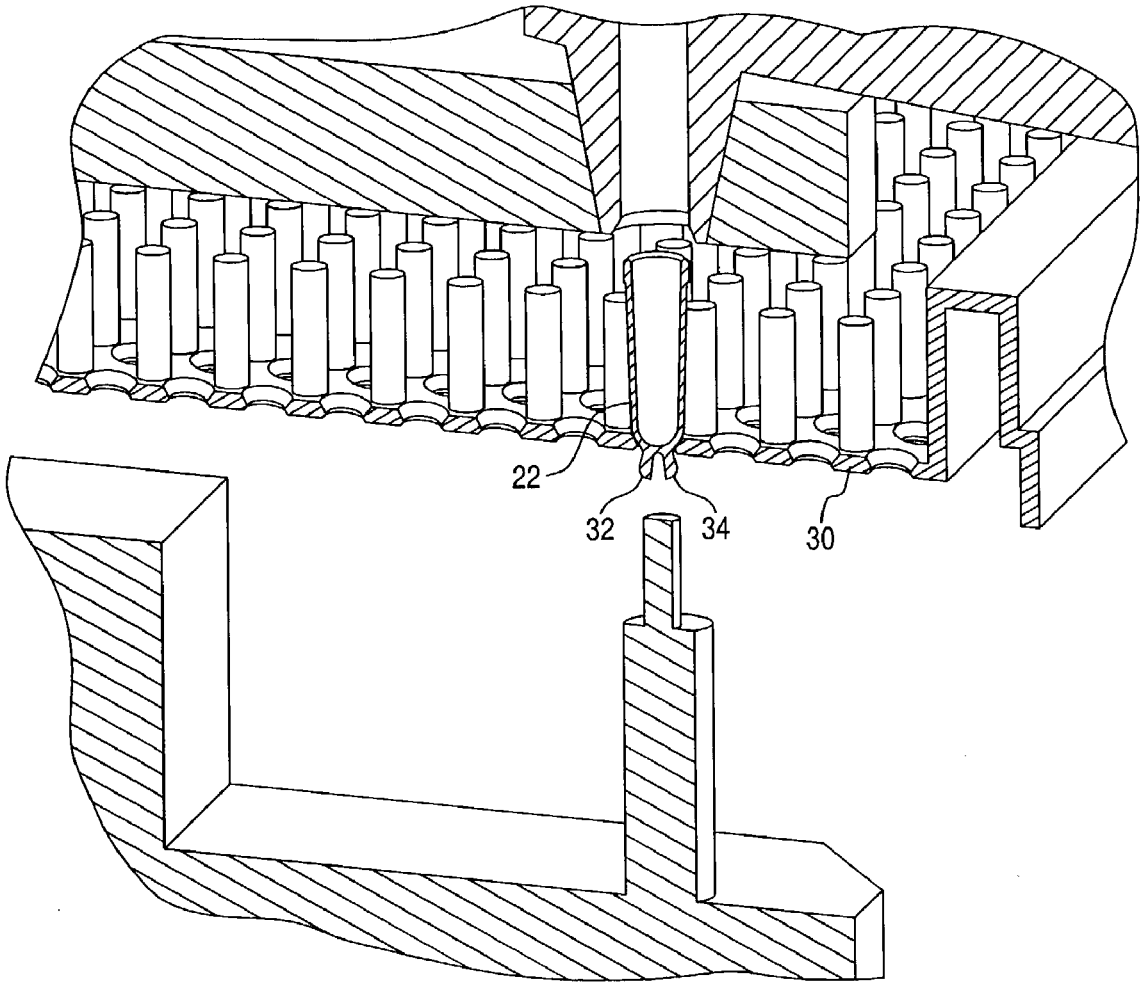
FIG. 10 is a close-up cross sectional perspective view of the robot end effector, minitube and receiving plate, in accordance with the present invention.
Figure 11:
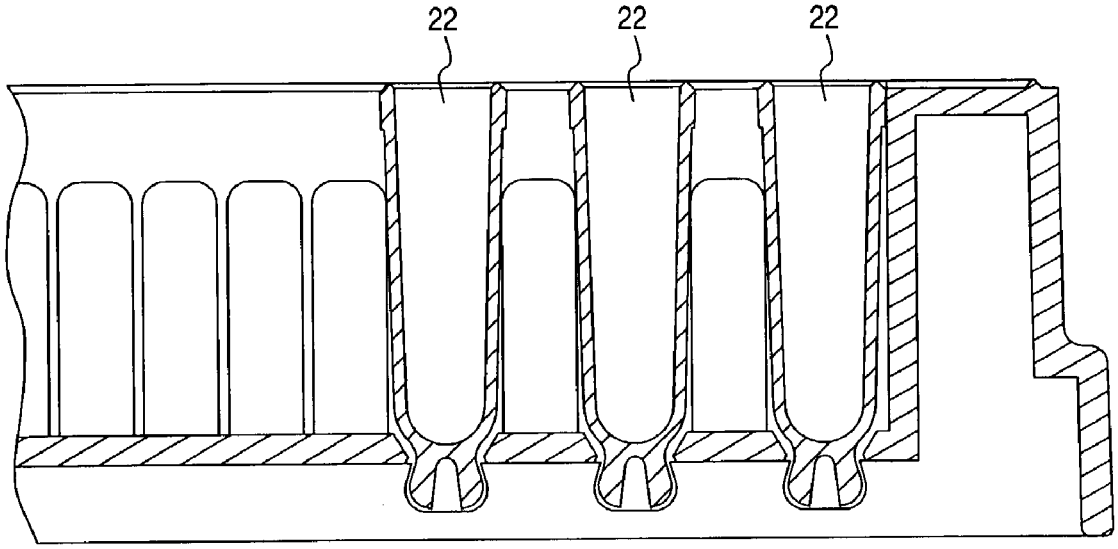
FIG. 11 is a cross sectional view of the minitube receiving plate with minitubes locked in place therein, in accordance with the present invention.
Figure 12B:
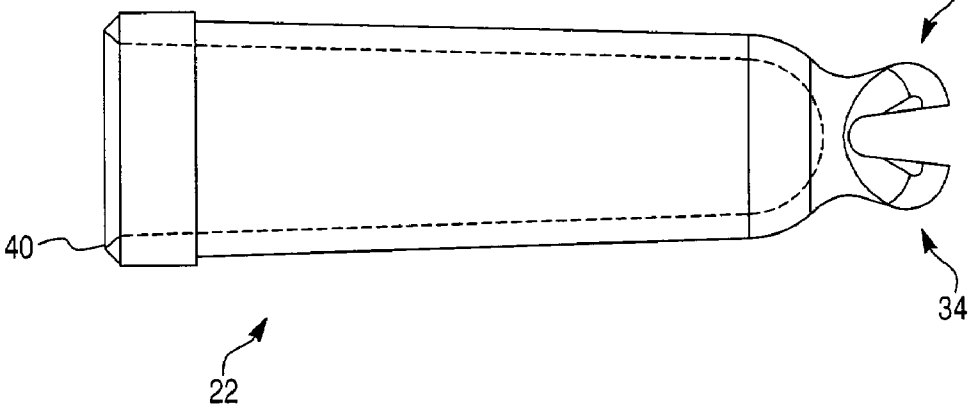
FIG. 12B is a side view, in elevation, of an individual minitube shelf keeping unit illustrating the sealing annular ridge and the "rabbit ear" detent lock members, in accordance with the present invention.
Figure 12A:
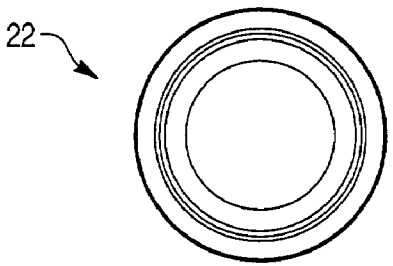
FIG. 12A is an end view, in elevation, of an individual minitube shelf keeping unit illustrating the sealing annular ridge, in accordance with the present invention.
Figure 13:
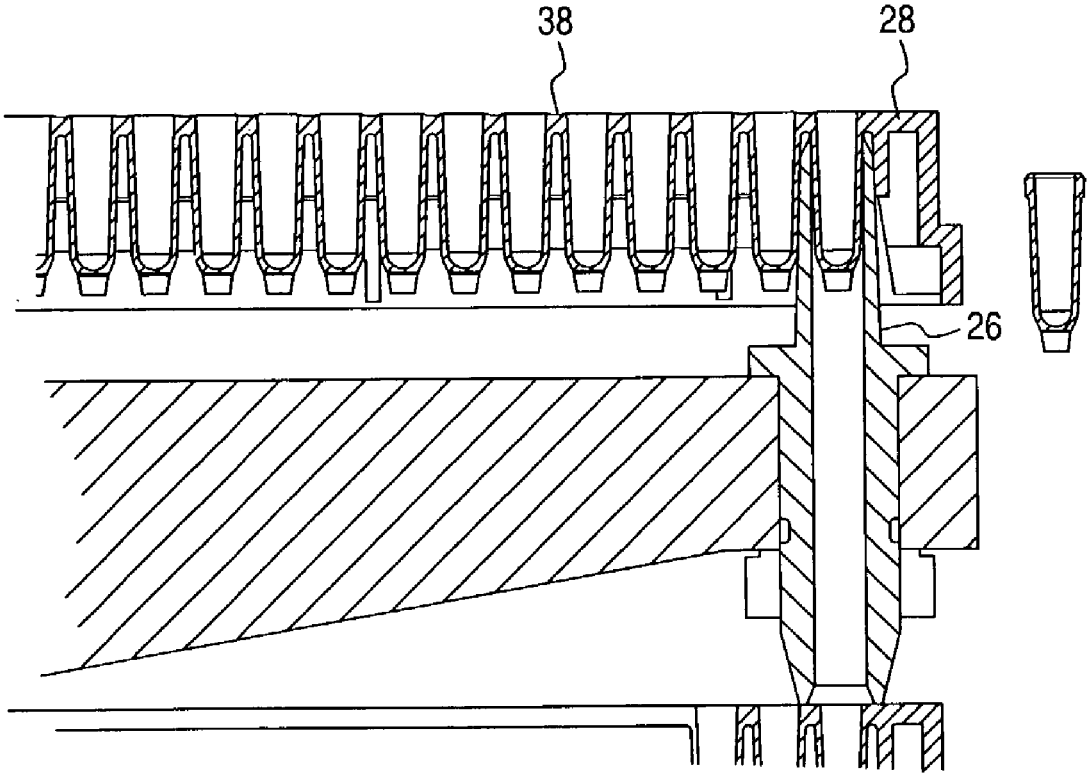
FIG. 13 is a cross sectional view of a minitube well plate and die cutting end effector in position to cut away a selected sealed individual minitube shelf keeping unit, in accordance with the present invention.
Figure 14:
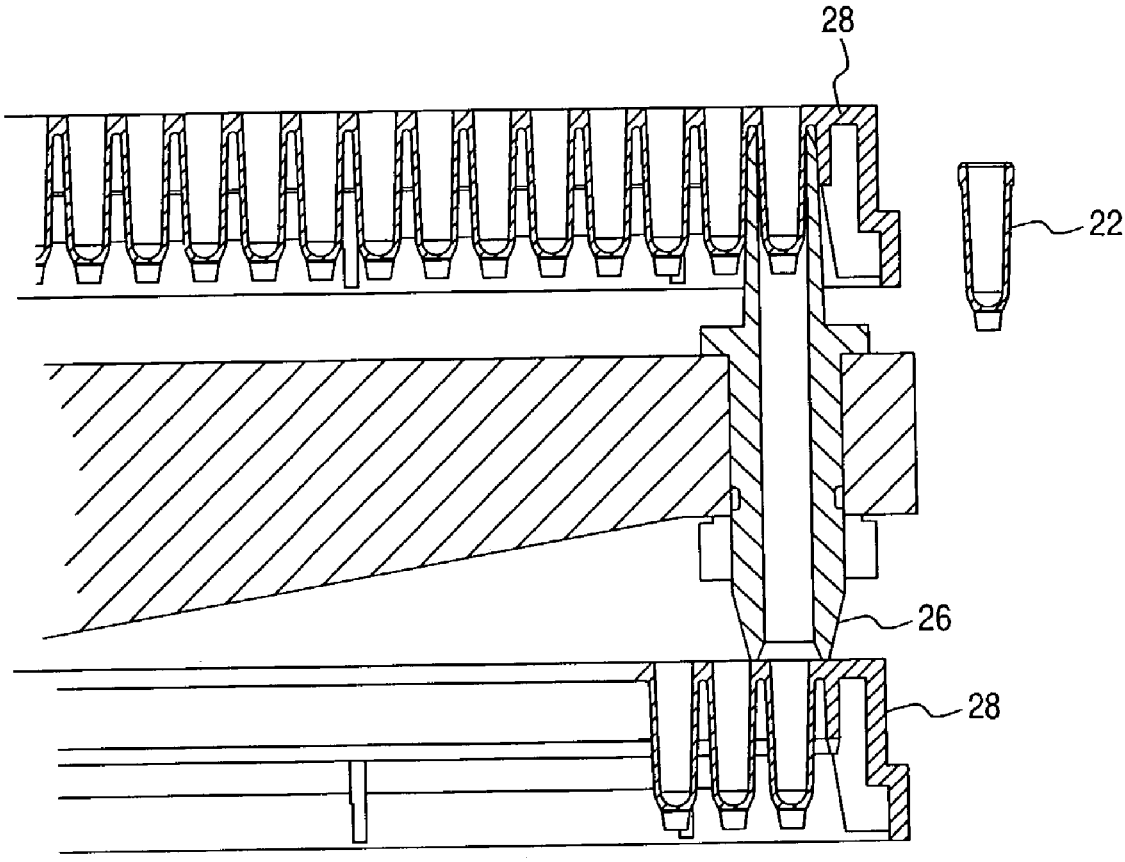
FIG. 14 is a cross sectional view of a minitube well plate and die cutting end effector in position to cut away a selected individual minitube shelf keeping unit, in accordance with the present invention.

Referring now to FIGS. 1-15, in accordance with the present invention, an automated miniature shelf keeping unit storage and retrieval system 20 uses a very small molded plastic shelf keeping unit or test tube known as a "minitube" 22. The minitubes 22 are stored in trays in (preferably) a standing refrigeration unit and are retrieved by a machine or robot 24 having a die cutting tubular end effector 26 adapted to selectively cut away and remove a minitube 22 from an integrally molded matrix 28 containing hundreds of minitubes (e.g., 384). The matrix is also called a minitube well plate 28 and preferably includes a sealing membrane or layer covering the upward facing openings of the minitubes. Upon cutting a selected minitube 22 away from the matrix, the end effector 26 is pushed over the selected minitube (as shown in FIGS. 13 and 14), thus forcing the minitube into the cylindrical interior lumen of the end effector 26, where it is retained by friction fit until such time as the minitube is to be releaseably locked into a plastic minitube receiving tray or plate 30 (as illustrated in FIGS. 2, 9 and 11).

Referring again to FIG. 1, automated miniature shelf keeping unit storage and retrieval system 20 preferably has a capacity of approximately twelve million minitubes 22, and larger capacities are possible. System 20 preferably includes integrated bar code scanners and has a "high priority interrupt" capability as well as a single minitube delivery capability. System 20 preferably includes adept robotics with adept vision guidance and incorporates a user-friendly interface and a Microsoft® SQL Server® database. System 20 preferably provides automatic plate sealing in an inert environment and cold storage (e.g., at minus twenty degrees Celsius) with redundant refrigeration and fail-safe features to protect against power loss, along with extensive data safeguards. System 20 is adapted for stand-alone use or can be networked to a compound ordering system.

Figure 7:
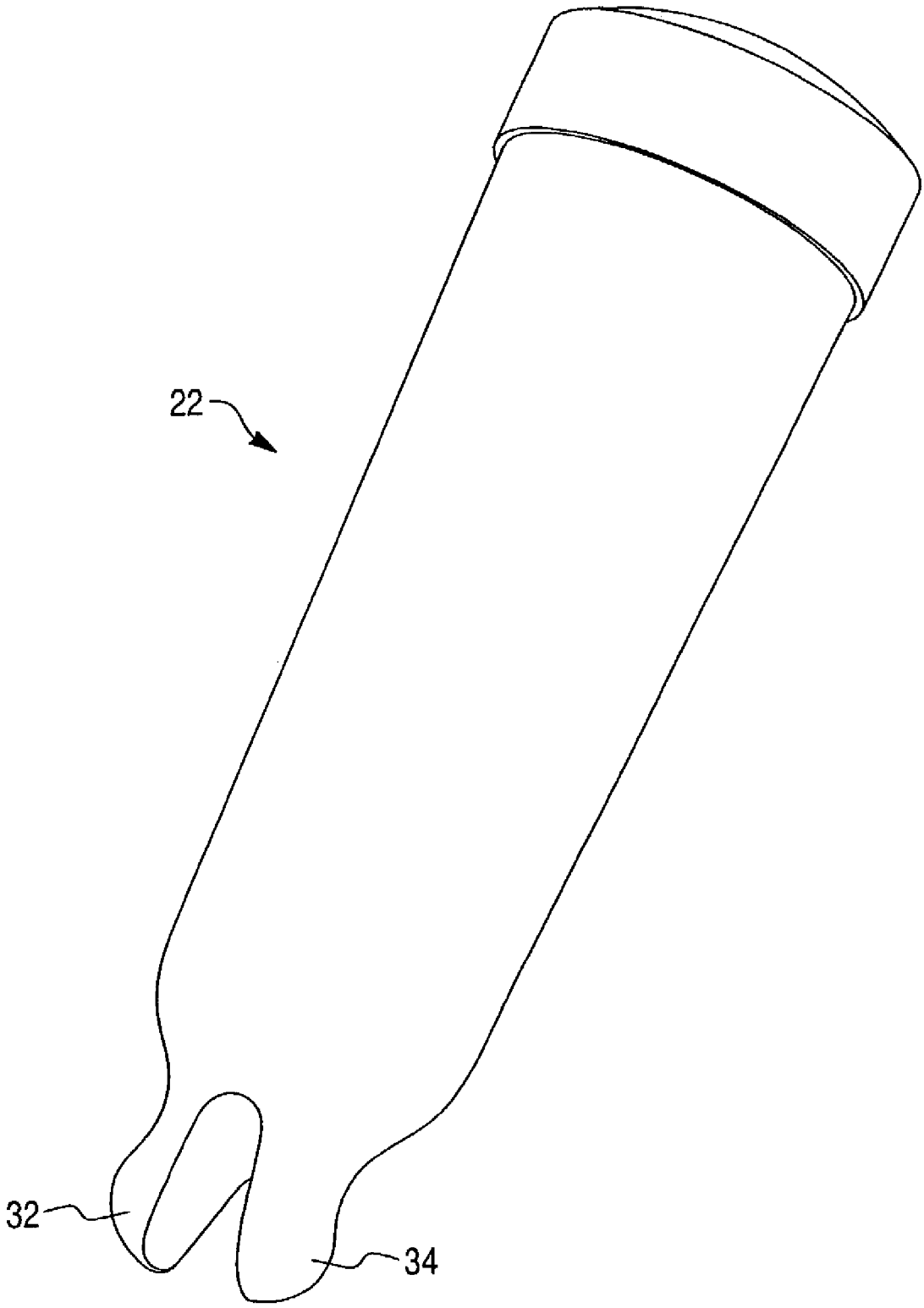
FIG. 7 is a perspective view of an individual minitube shelf keeping unit, in accordance with the present invention.
Figure 8:
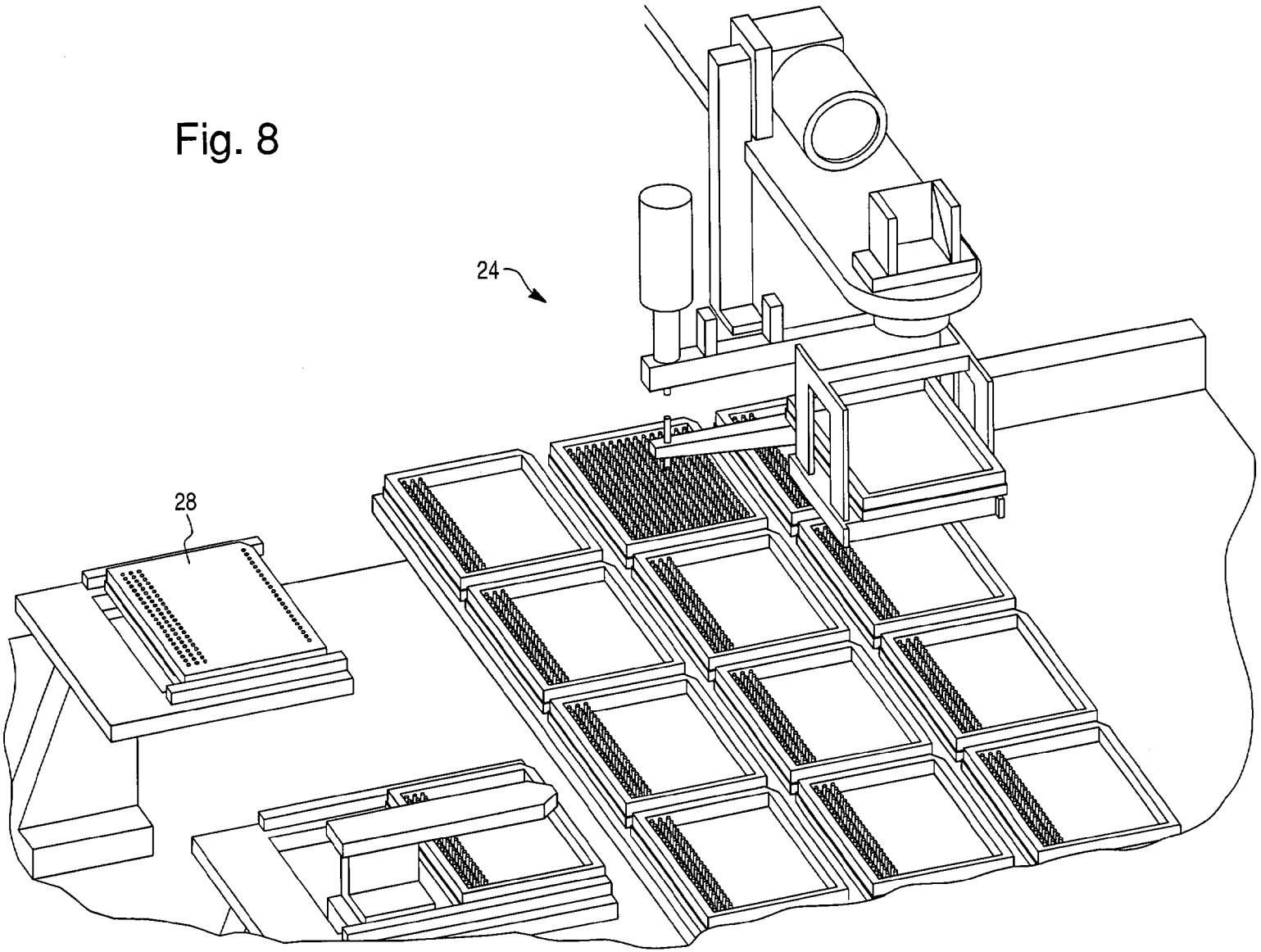
FIG. 8 is a perspective view of the minitube automated retrieval robot system, in accordance with the present invention.

Minitubes are stored and moved from place to place in the receiving plate 30 which is adapted to receive and releaseably hold or lock the tubes in place. As best seen in FIGS. 2, 7 and 12, minitube 22 is a molded plastic tube having distally projecting spaced apart "rabbit ear" detent lock members 32, 34 which are biased transversely or outwardly. The plastic receiving tray has apertures sized to receive the minitubes and each aperture of the tray is terminated at bottom in a hole 36 defined within chamfered shoulders adapted to slidably engage and exert transverse force against the minitube rabbit ears 32, 34. The rabbit ears 32, 34 and the hole 36 together comprise a detent lock system. The minitube rabbit ears releaseably engage the shoulder surfaces on the bottom of the hole in each aperture of the receiving plate or tray 30. The robot end effector 26 can withdraw and replace the tubes 22 as needed to perform automated testing.

The minitube receiving tray or plate 30 includes spaces aligned in twenty four columns and rows A through P. That number of minitubes 22 was selected for storage because the standard three hundred and eighty four element well plate from the Society for Biomolecular Screening (SBS) provides exterior dimensions (e.g., as cited above and described in the attached appendices). Conformance with the SBS standard was an important goal of developing the method and apparatus of present invention.

The problem presented was to mold the entire 384 well cassette (also referred to as the minitube well plate or matrix 28) as one unit, in a functional unit that doesn't need any further assembly. The minitube well plate, once out of the mold, is already in a shape compatible with the format called the SBS Plate or the 384 well plate, so it's ready to use as-is, coming out of the mold (not shown).

In use, the individual minitubes 22 are periodically taken out and "reformatted" into another plate 30, e.g., having a different makeup of compound in the minitubes. A receiving plate 30 may include, for example a random assortment in the 384 well plates throughout the system and a user may need to pick one out of each of these plates and put it in another entire set-up of plates, ordering them for the request. In response to the request, the minitubes 22 are punched out of a minitube well plate 28 with the die end effector 26 and placed in a receiving plate 30 in such a way that the minitube can be used in the laboratory. The minitube 22 cannot be laid loosely in the plate aperture, instead, each minitube has to be pressed in and releaseably locked in or retained such that it won't come back out until selectively removed using the robot end effector 26.

Minitube well plate 28 comprises a molded matrix structure including the minitubes 22 molded integrally with the holder. The volume of each minitube 22 is preferably about sixty microlitres, and the exterior dimensions of each minitube illustrated in FIG. 12 and are optimized to conform to the SBS spacing standard for dimensions a 384 tube well plate. The minitube design provides the largest volume that's functional in that format and size. Within the SBS standard format, the tube structure provides maximum usable volume. Each minitube 22 has a rounded or pointed bottom, so that the pipette can reach close to the bottom, and get almost all of the material out. There are a large number of standard pipettes that are available. A cross-section of pipettes was studied to ensure they could fit down to the bottom easily without hitting the side. Well known pipette companies include Tecan, Becton-Dickenson, and Perkin Elmer.

Returning to minitube well plate 28, the top surface 38 is substantially planar and all of the minitubes 22 are arranged in an evenly spaced pattern in a two dimensional array, in substantial conformance with the above cited SBS "well positions" draft standard, SBS-4. The minitube well plate of the present invention shares certain characteristics with standard (SBS-4) plate, but differs in the minitube configuration as seen from the bottom in that the minitubes are integrally molded into the plate structure.

The planar top or upper surface 38 which permits an operation covering all of the minitubes at once. On that planar top surface 38, and around each circular hole defining the minitube openings, where the minitube is molded in, there is a small annular ridge 40 around each hole—one can feel ridge 40 with a fingernail. Annular ridge 40, best seen in FIG. 12, is raised and is used for heat sealing. A foil sheet with a polymer back is used to seal all the minitubes in the well plate 28 at once. The foil sheet polymer layer melts to the polymer on the minitube well plate ridge 40, thus independently sealing each tube at the annular ridge. The point of contact is the little ridge around each well or minitube interior and so each tube 22 is completely sealed. Each minitube 22 remains sealed after it's been cut and released by the die cutter/holder end effector 26.

The preferred "membrane material" for affixing the sealing cover is a commercially available aluminum foil having a polymer coating on the back. The polymer coating may be polypropylene or polyethylene.

When attaching the foil to the minitube well plate 28, even heat and pressure is applied over the entire top surface using a pair of platens (not shown). A smooth top platen on the top surface and a platen underneath having holes cut out for each of the (e.g., 384) tubes 22 so that the actual point of contact of the bottom platen is right at the top of the minitube well plate inner wall. Thus, when closed in the heat sealing operation, the two platens are essentially about a sixteenth of an inch apart, a span corresponding to the thickness of the minitube well plate top wall segment. During sealing, the bottom platen comes into intimate contact with the underside of the minitube well plate 28, and so acts essentially like a female mold, adapted to receive it the underside of the minitube well plate completely, whereas the top platen is just a flat rectangular piece that is slightly larger in area than the minitube well plate planar top surface 38.

During the heat sealing process, the minitube well plates 28 are supported at the very bottom of the plate while the platen on top pushes down, so a very uniform pressure is applied, thereby achieving, among other things, enhanced reliability in the sealing of individual tubes 22.

Returning to the annular sealing ridge 40, and referring to FIG. 12 which shows the ridge (diameter of 0.122"); it is substantially triangular in cross section (and has a height of 0.009"). In fact, there are many useful sealing methods, this ridge shape has been used for ultrasonic sealing as well as heat sealing and there's a pretty wide and forgiving range of ridge shape to present a high spot to take the pressure first and achieve the desired sealing melt. The melt must bond the sealing membrane completely around the circumference of the minitube and it is important that the bond that is created not be undone when the die cutter reaches in and cuts the minitube out of the well plate.

The die cutter shape or dimensions (of end effector 26) are dictated in part by the goal or reliable sealing. Particularly, the die cutter has an angled edge, e.g., 20 degrees to the inside, whereby a knife-like beveled edge is presented. Referring to FIGS. 13-15 and FIG. 9, the beveled edge is preferably very sharp; the balance is between having a shallower angle (rendering cleaner cut) or a larger angle (rendering longer wear), for longevity. At present, the priority is functionally making clean cuts, so the seals are reliably intact after the cutting step has taken place. A sharp cutting edge also helps maintain the flatness of planar surface 38, over the whole plate, during the removal of all the tubes. The removal process is usually random in that tubes 22 are removed at one point and then another and another. The typical completely random request process for the chemicals in these tubes might have three or four tubes remaining right in the middle of matrix 28 after everything else is punched out around them, and a relatively flat well-oriented web must be maintained to hold those few tubes. That's another reason why a very sharp cutting beveled edge is required, so that the minitube well plate top surface 38 remains substantially planar as the tubes 22 are cut out.

Figure 15:
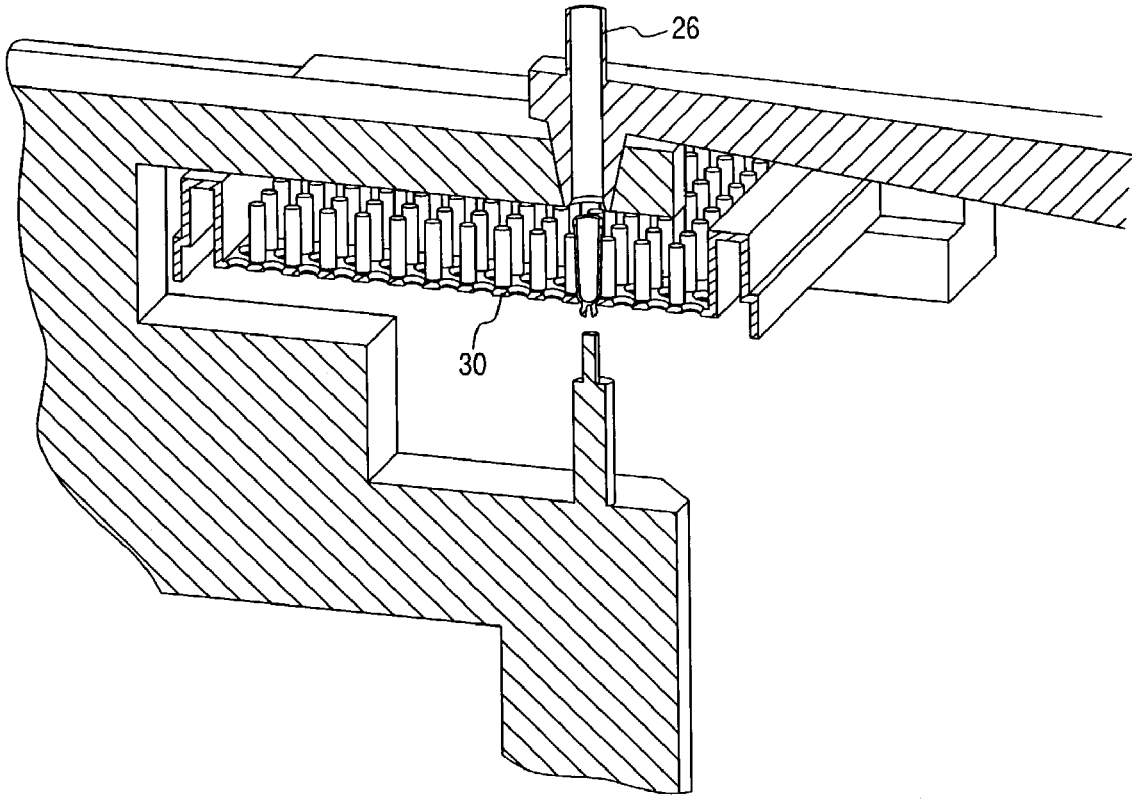
FIG. 15 is an enlarged cross sectional perspective view of the robot end effector, minitube and receiving plate of FIG. 9, in accordance with the present invention.

As best seen in FIGS. 7 and 12, minitube 22 is tapered from top to bottom, having a gently decreasing diameter from top to bottom and being circular in cross-section. The die cutter of end effector 26, as best seen in FIGS. 13-15, has an interior defining a straight cylindrical lumen. The end effector cutting edge is on the outside of the cylinder, and the outside is tapered for strength. The die cutter body also has a taper at the top (best seen in FIG. 13) that creates the beveled knife edge. There is a dual taper there; a two degree taper mirroring the minitube taper, so the adjacent minitubes allow for a two degree outward taper on the end effector cutting die. The minitube 22 uses every bit of material that will fit within the clearances defined by adjacent placements of the die cutter. The die cutter taper gives more tool strength and the tapered area around each minitube allows for that clearance and allows the die cutter to have that taper outward.

Turning now to some additional details of the minitube invention, the shape of the rabbit ears and the method of putting a minitube in the holding tray and withdrawing are important novel elements of the invention. The prior art, by comparison, involves much greater cost, because separately molding 384 little tiny tubes and inserting them in a matrix of 384 little square sockets is a very costly assembly. The present invention, by way of contrast, replaces that assembly with something less expensive; the method of the present invention includes molding the entire 384 well cassette as one unit, in a functional unit that doesn't need any further assembly. It's just one piece, one out of the mold, already in the format of the SBS Plate, or the 384 well plate, so it's ready to use as-is, coming out of the mold. Now that's all well and good but what needs to happen from there is these individual tubes need to be taken out and reformatted into another plate having a different makeup of compound (whatever the compounds are in those little tubes). It might be, a random assortment in the 384 well plates throughout the system and the user may need to pick one out of each of these plates and put it in another entire set-up of plates, such that there's an order to them now for this request. And so, in the method of the present invention, the molded-in minitubes are punched out and placed in such a way that they can be used in the laboratory. The minitubes can't just be laid in there, they have to be pressed in, in such a way that the minitubes won't come back out. And thats why the minitubes have ears which are received in the receiving tray holes. The little ears or detents, when they're pressed in, they snap into place and then hot or cold, warm or cold, it doesn't really matter because they're now retained, and snapped into place.

Referring now to the refrigerated storage, the pick and place robotic equipment is novel and more efficient as a result of this minitube structure. The robotic equipment is called an end effector, and is essentially a punching unit that has a punch and a die set up. The punch is a two stroke set-up that, in the first part of the stroke or the first stroke, is used to actually shear the tube out of the molded matrix. The minitube is retained by friction in the die and then the whole unit goes over to the receiving cassette or tray and then the second stroke is all the way through the die, the punch goes all the way through the die down to the bottom and presses the minitube into place in the receiving cassette or tray. Once that minitube is put into the receiving cassette, it can actually be extracted from that receiving cassette and put into another receiving cassette, which allows what is called compression, meaning one can take out the remaining tubes in a well plate—e.g., if one has 384 to start and over a period of, say, six months 350 are taken out, then 34 are left, one can punch those 34 out and place them in a receiving cassette. In addition, the user can extract minitubes out of the receiving tray; instead of punching them out, the system includes a little extractive tool or pin that pushes up from the bottom through the receiver cassette ear-retaining hole and actually replaces that tube inside the die of the punch and die, a feature shown in cross section in the drawings.

Having described preferred embodiments of a new and improved method, apparatus and system it is believed that other modifications, variations and changes will be suggested to those skilled in the art in view of the teachings set forth herein. It is therefore to be understood that all such variations, modifications and changes are believed to fall within the scope of the present invention as defined in the claims.

I claim:

1. A unitary array of a plurality of miniature shelf keeping units, comprising:

a substantially planar one-piece molded tray including a plurality of integrally molded tube structures, each of said tube structures having a selected outside diameter, said tray having an upper surface and a plurality of side walls carried in a substantially perpendicular orientation with respect to said upper surface;

each said integrally molded tube structure defining a hollow cavity terminated at a distal end in a closed, fluid tight boundary and terminated at a proximal end in an opening in fluid communication with said tube hollow cavity;

said tube proximal end openings being aligned in a plane that is substantially co-planar with said tray upper surface; and a pair of flexible circumferentially-spaced rabbit ear-shaped prongs projecting angularly downwardly and outwardly at the distal end of said tube, whereby when a tube is inserted in apertures of a receiving plate, the prongs are pressed radially inwardly to engage shoulder surfaces of a recess at the bottom of the apertures in the receiving plate to facilitate easy withdrawal and replacement of tubes in the apertures when performing automated testing.

2. A unitary array as claimed in claim 1 including a sheet of heat sealable material affixed to the open end of the array of mini tubes.

3. A unitary array as claimed in claim 1 including a generally triangular-shaped ridge at the open and of said tubes to facilitate hermetic sealing.

* * * * *